US005940663A

United States Patent [19]

Mizunuma et al.

[11] Patent Number: 5,940,663

[45] **Date of Patent: *Aug. 17, 1999**

[54] IMAGE EXPOSURE APPARATUS

[75] Inventors: Noboru Mizunuma, Yokohama; Mitsuo Nimura, Kawasaki; Kazumi Kimura, Toda, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/575,695

[22] Filed: Dec. 19, 1995

[30] Foreign Application Priority Data

Dec. 28, 1994 [JP] Japan ..... 6-338447

[51] Int. Cl.[6] ..... G03G 15/04; G03G 15/28

[52] U.S. Cl. ..... 399/201; 399/196; 355/55

[58] Field of Search ..... 354/195.1; 355/235, 355/208, 243, 55–57; 396/358, 353; 399/196–202

[56] References Cited

U.S. PATENT DOCUMENTS

| | | | |
|---|---|---|---|
| 4,903,079 | 2/1990 | MacAndrew | 355/235 |
| 5,045,763 | 9/1991 | Kobayashi et al. | 355/235 |
| 5,191,376 | 3/1993 | Hayashi | 355/235 |
| 5,221,974 | 6/1993 | Kusumoto et al. | 355/235 |
| 5,369,465 | 11/1994 | Kuwahara | 355/243 |
| 5,450,175 | 9/1995 | Sato et al. | 355/235 |
| 5,508,791 | 4/1996 | Besshi et al. | 355/235 |

*Primary Examiner*—Safet Metjahic
*Assistant Examiner*—Michael Dalakis
*Attorney, Agent, or Firm*—Fitzpatrick, Cella, Harper & Scinto

[57] ABSTRACT

An error between a set value of magnification and an actual value of magnification is reduced by correcting the amounts of movement of a single-focus lens unit and a mirror in accordance with a production error in the focal length (in accordance with the lot number) of the single-focus lens unit.

4 Claims, 11 Drawing Sheets

FIG.9

| TABLE OF AMOUNT OF LENS MOVEMENT Xm FOR EACH MAGNIFICATION FROM POSITION OF100% | |
|---|---|
| MAGNIFICATION m(%) | AMOUNT OF LENS MOVEMENT Xm(mm) |
| 70 | $X_{70}$ |
| 71 | $X_{71}$ |
| 72 | $X_{72}$ |
| . | . |
| . | . |
| 99 | $X_{99}$ |
| 100 | 0 |
| 101 | $X_{101}$ |
| . | . |
| . | . |
| 140 | $X_{140}$ |
| 141 | $X_{141}$ |
| . | . |
| . | . |

CONVENTIONAL APPARATUS

IMAGE EXPOSURE APPARATUS

BACKGROUND OF THE INVENTION

1. Field of the Invention

This invention relates to an image exposure apparatus which can focus an image of an original onto a surface to be exposed by changing magnification, and more particularly, to an image exposure apparatus which includes an optical system including a single-focus lens unit and a mirror that moves when switching the length of an optical path.

2. Description of the Related Art

The following two types of apparatuses are typical image exposure apparatuses for focusing an image of an original onto a surface to be exposed by changing magnification. One is a zoom-lens-type image exposure apparatus which changes the distance among a plurality of lenses in accordance with magnification. This type of apparatus has a feature in that the length of the optical path between an original and a surface to be exposed can be maintained constant irrespective of magnification. Such a configuration is effective for reducing the size of the apparatus. Another is a mirror-zoom-type image exposure apparatus, in which a single-focus lens unit is moved in the direction of the optical axis in accordance with magnification, and a mirror is moved for switching the length of an optical path. Since the apparatus of this type requires a smaller number of lenses than the zoom-lens type apparatus, a decrease in the amount of light when light passes through the lens unit is smaller. Accordingly, a light source having a relatively small amount of light emission, such as a fluorescent lamp, can be used as a light source for illuminating an original, and therefore power consumption can be reduced.

FIG. 14 is a schematic diagram illustrating a magnification-varying mechanism of such a mirror-zoom-type image exposure apparatus.

In FIG. 14, a lens unit 35 having a single-focus lens, and a moving-mirror-mount unit 40 constituting a moving-mirror system are disposed at appropriate positions in the optical path of the apparatus. The lens unit 35 is driven by a motor 30 via a gear-wire system, comprising gears 31 and 32, a pulley 33, and a wire 34. That is, one end 34 a of the wire 34 provided via the gear 32 and the pulley 33 is connected to the upper left end of the lens unit 35, and another end 34b of the wire 34 is connected to the upper right end of the lens unit 35. Hence, the lens unit 35 can move in the direction of an arrow E in an enlargement mode, and in the direction of an arrow R in a reduction mode.

The driving force from the motor 30 is also transmitted to a gear 36 and to a cam 37 integrated therewith, and further to the mirror-mount unit 40 via link means 38 which is made in contact with the outer circumferential surface of the cam 37 by spring means 41. Thus, the lens unit 35 moves in the direction E when magnification is greater than 1, and in the direction R when magnification is smaller than 1. On the other hand, the mirror unit 40 moves to a left end position when magnification is 1, and moves toward the right in the directions E and R when magnification is greater than 1 and is smaller than 1, respectively.

In such a mirror-zoom-type image exposure apparatus, focus adjustment is performed by finely adjusting the relative position between the lens unit 35 and the mirror-mount unit 40 using a connection unit 39 for connecting the link means 38 to the mirror-mount unit 40.

Magnification adjustment is performed as follows.

As can be understood from FIG. 14, a lens barrel 42 disposed within the lens unit 35 is first adjusted in a direction of the optical axis (right or left in FIG. 14), and is then fixed at an appropriate position using an adjusting screw 43*a* which can freely move within a slit 42*a*.

The cam 37 for moving the mirror-mount unit 40 in a direction of the optical axis in synchronization with the movement of the lens unit 35 is fixed by causing the distal-end portion of the link means 38 to coincide with initial-position reference (for example, a scratched line, a projection or the like) provided in advance on the cam 37. The initial-position reference is provided, for example, at such a position that an image on an imaging surface has unit magnification with respect to an image on an original. The operation of the coincidence is performed by loosening an adjusting screw 37*b* fitted in a slit 37*a* provided in the cam 37, slightly rotating the cam 37, and tightening the adjusting screw 37*b* at an appropriate position.

The positions of the lens unit 35, the mirror unit 40 and the cam 37 are fixed in the above-described manner so that the image on the imaging surface and the image on the original are in the relationship of unit magnification. At that time, if optical characteristics of the lens unit 35 and the shape of the cam 37, and the like coincide with respective designed values, varying magnification coincides with a designed value even if the lens unit 35 and the mirror unit 40 are moved to the position of the maximum or minimum magnification.

Actually, however, the focal length of the lens unit 35 and the shape of the cam 37 have production tolerance, and therefore varying magnification which coincides with a designed value, and an expected state of focus on the imaging surface are not always obtained. As for focus on the imaging surface, if accuracy in components is within the range of tolerance, a focused state is obtained with accuracy within a provided range due to allowance in the depth of focus. However, as for varying magnification, even if accuracy in components is within the range of tolerance, the difference between a designed value and an actual value is relatively large, as shown in FIG. 5. The difference is particularly influenced by tolerance in the focal length of the lens unit. FIG. 5 illustrates measured values of magnification when seven kinds of lens units having focal lengths of 0.97–1.03 are used. As shown in FIG. 5, even if the positions of the lens unit 35 and the mirror unit 40 are adjusted in a state of unit magnification, actual values of magnification greatly deviate from designed values at the minimum and maximum values of magnification. This indicates that even if the operator sets a value of magnification, the actual value of magnification of an output image differs from the set value. If it is intended to increase accuracy in components is in order to solve such a problem, the production cost will increase.

SUMMARY OF THE INVENTION

The present invention has been made in consideration of the above-described problems.

It is an object of the present invention to provide an image exposure apparatus having a small difference between a set value of magnification and an actual value of magnification irrespective of tolerance in the focal length of a lens.

It is another object of the present invention, to provide an image exposure apparatus which can make easier an optical adjustment operation.

It is still another object of the present invention to provide an image exposure apparatus which has excellent optical characteristics while preventing an increase in the production cost.

According to one aspect, the present invention, which achieves these objectives, relates to an image exposure apparatus which includes an optical system capable of focusing an image of an original onto a surface to be exposed by changing magnification. The optical system includes a single-focus lens unit movable in a direction of an optical axis, and a mirror which moves when switching the length of an optical path. The apparatus also includes a driving device for moving the single-focus lens unit and the mirror, a control device for controlling an amount of driving of the driving device in accordance with magnification, and a registration device for registering a correction value for correcting the amount of driving.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 4(*a*) illustrates a state at unit magnification; and FIG. 4(*b*) illustrates a state at enlargement;

FIG. 9 is a table of the amount of lens movement Xm in the image exposure apparatus of the first embodiment;

DETAILED DESCRIPTION OF THE PREFERRED EMBODIMENTS

First Embodiment

Figure 1:
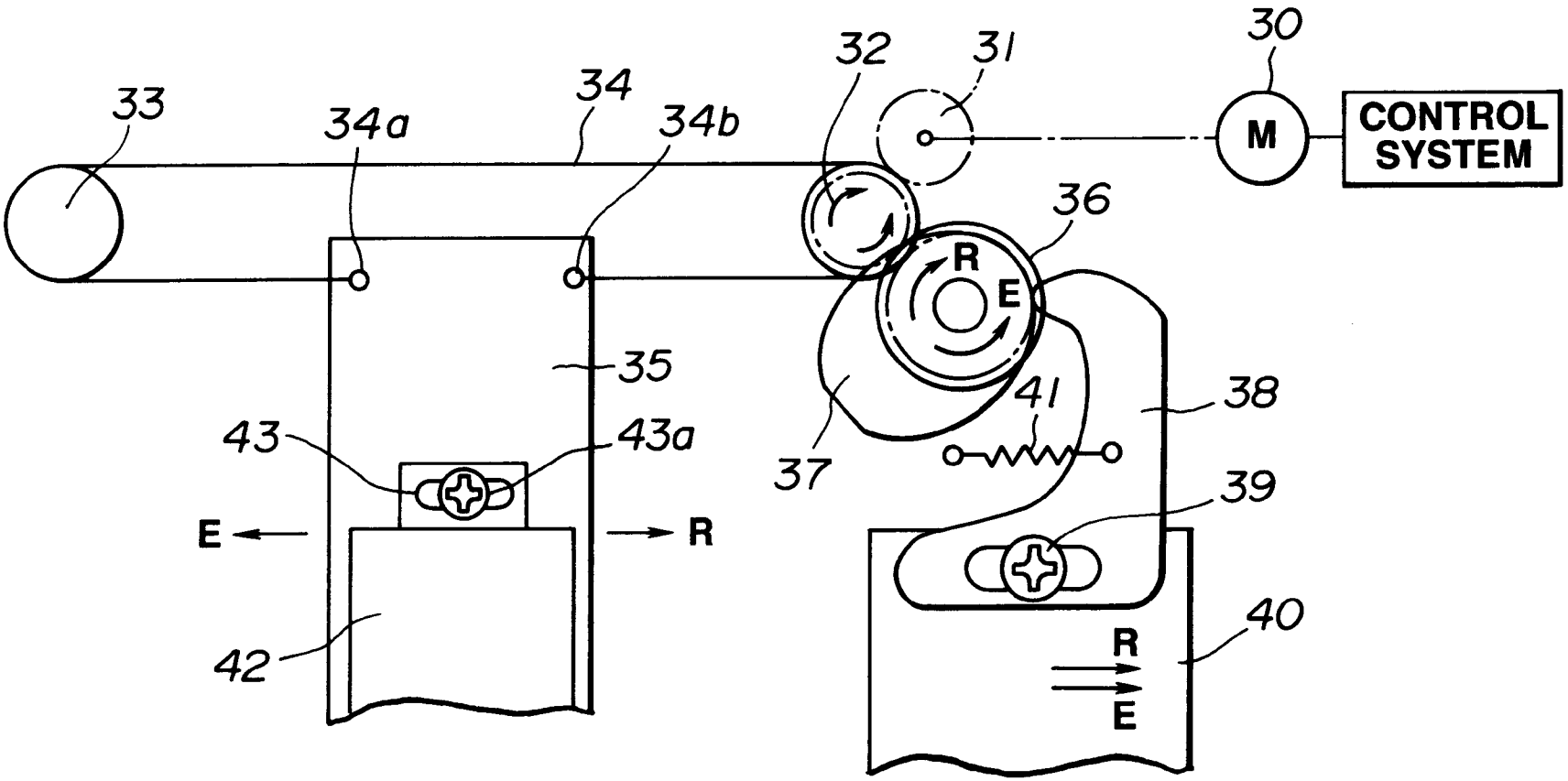
FIG. 1 is a schematic diagram illustrating the configuration of an image exposure apparatus according to a first embodiment of the present invention.
Figure 2:
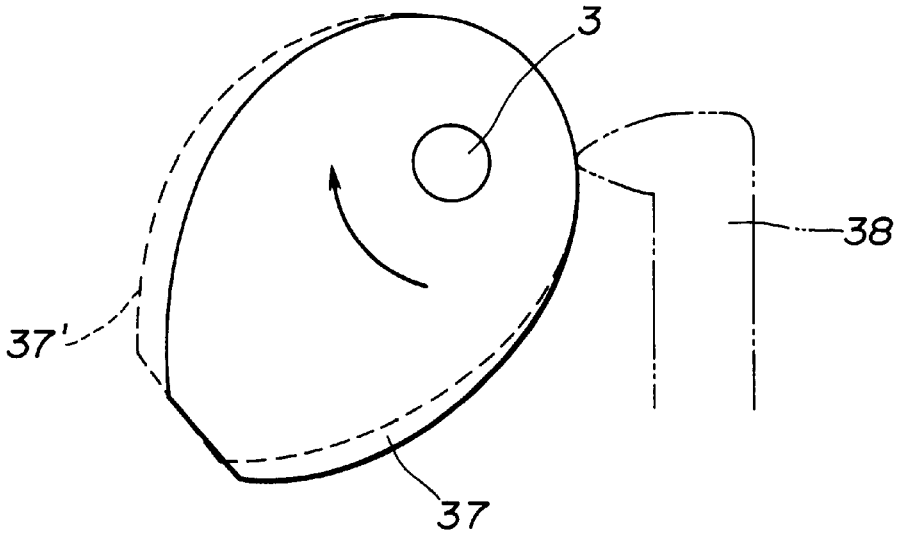
FIG. 2 is a diagram illustrating a state of connection between a magnification-vaying cam and link means shown in FIG. 1.
Figure 3:
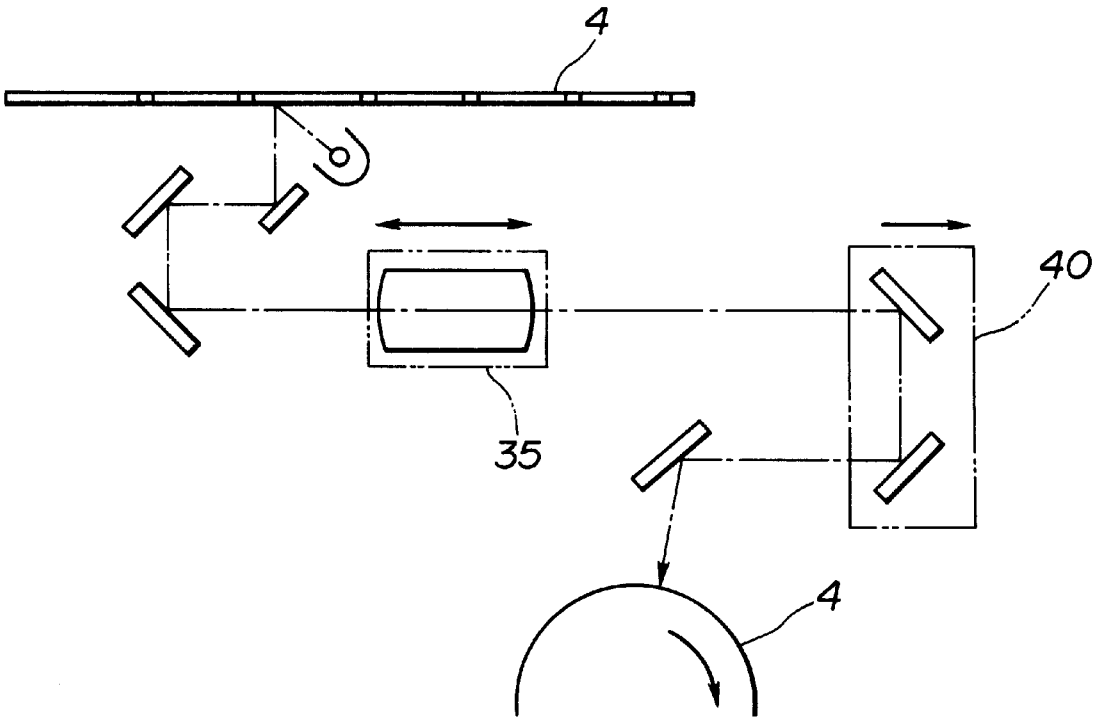
FIG. 3 is a schematic diagram illustrating the configuration of a principal portion of an image forming apparatus which uses the image exposure apparatus of the first embodiment.
Figure 14:
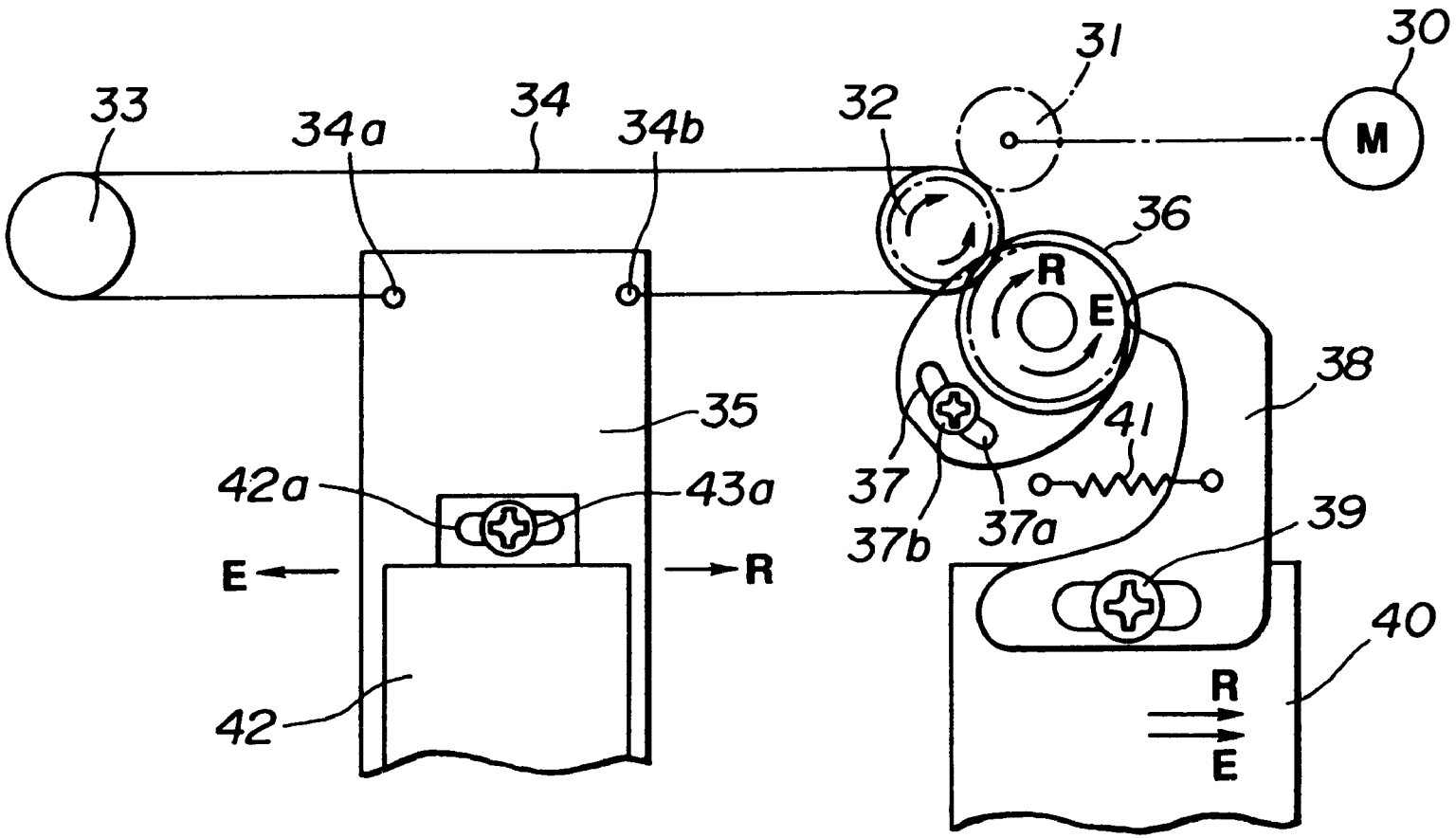
FIG. 14 is a schematic diagram illustrating the configuration of a conventional image exposure apparatus.

FIGS. 1 through 3 illustrate an image exposure apparatus according to a first embodiment of the present invention. In FIGS. 1 through 3, the same components as those shown in FIG. 14 are indicated by the same reference numerals.

This image exposure apparatus is used in a copier which uses an electrophotographic technique. As shown in FIG. 3, a lens unit 35, including a single-focus lens (comprising a lens group (not shown) and a lens barrel 42), and a mirror-mount unit 40 for switching the length of the optical path of the apparatus in accordance with magnification, are disposed at appropriate positions in the optical path of the apparatus.

The lens unit 35 is driven by a motor 30 via a gear-wire system, comprising gears 31 and 32, a pulley 33, and a wire 34. That is, one end 34*a* of the wire 34 provided via the gear 32 and the pulley 33 is connected to the upper left end of the lens unit 35, and another end 34b of the wire 34 is connected to the upper right end of the lens unit 35. Hence, the lens unit 35 can move in the direction of an arrow E in an enlargement mode, and in the direction of an arrow R in a reduction mode.

The driving force from the motor 30 is also transmitted to a gear 36 and to a cam 37 integrated therewith, and further to the mirror-mount unit 40 via link means 38 which is made in contact with the outer circumferential surface of the cam 37 by spring means 41. Thus, the lens unit 35 moves in the direction E when magnification is greater than 1, and in the direction R when magnification is smaller than 1. On the other hand, the mirror unit 40 moves to a left end position when magnification is 1, and moves toward the right in the directions E and R when magnification is greater than 1 and is smaller than 1, respectively.

In adjustment of the optical system, focus adjustment is performed by finely adjusting the relative position between the lens unit 35 and the mirror-mount unit 40 using a connection unit 39 for connecting the link means 38 to the mirror-mount unit 40.

When assembling the image exposure apparatus, first, in order to provide a state in which an image on an imaging surface (a photosensitive member) has unit magnification with respect to an image on an original, a lens barrel 42 disposed within the lens unit 35 is fixed to the main body of the lens unit 35 using a screw 43*a* at an appropriate position in a direction of a slit 43. The cam 37 is fixed by causing the distal-end portion of the link means 38 to coincide with initial-position reference (for example, a scratched line, a projection or the like) provided in advance on the cam 37. In the present embodiment, this reference represents the contact position of the link means 38 at unit magnification.

FIG. 2 is an enlarged view of the cam 37 and the link means 38.

Although to be described later, in the present embodiment, magnification adjustment of adjusting an actual value of magnification to a set value of magnification is peformed by only selecting one of a plurality of correction values for the amount of movement of the lens unit, which are stored in advance in the apparatus, in accordance with the focal length of the lens unit. That is, by only selecting one correction value in accordance with the lot number of the lens or the lens unit when assembling the apparatus, the lens unit and the mirror unit move in a direction of the optical axis by a larger (smaller) amount equal to the amount of correction than a predetermined amount corresponding to magnification.

Figure 4A:
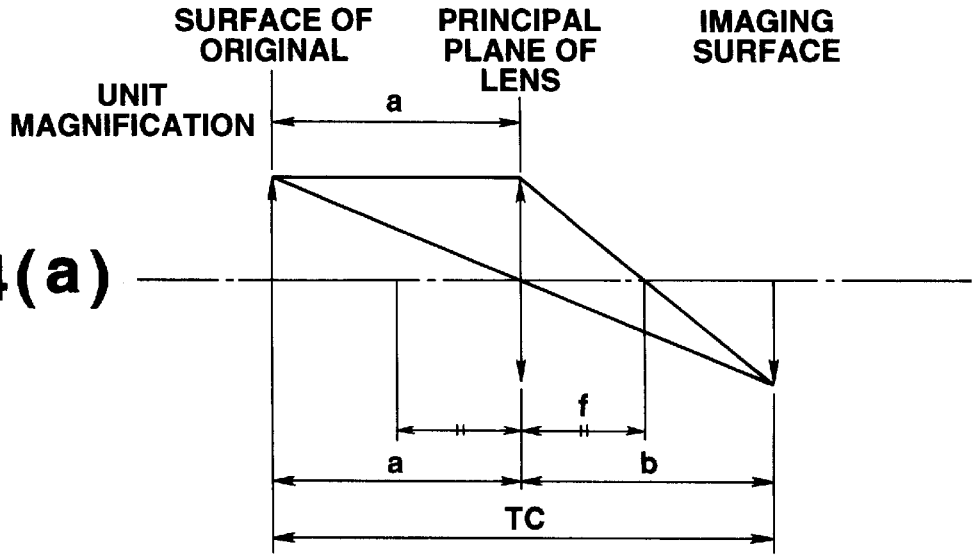
FIGS. 4(*a*) and 4(*b*) are model diagrams illustrating the principle of magnification adjustment.
Figure 4B:
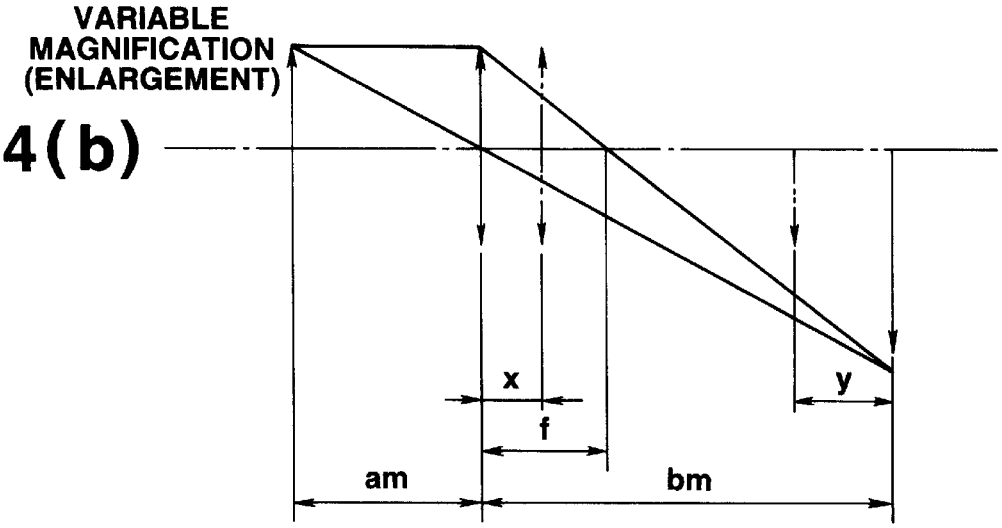

Next, a description will be provided of the principle of adjustment of magnification of the optical system, and means for adjusting magnification according to the present invention (see FIGS. 3 through 4(*b*)). For the sake of convenience, a moving-mirror system in the optical system is neglected.

By neglecting the distance between principal planes and defocusing characteristics of a single-focus lens (hereinafter abbreviated as a "lens"), the amount of lens movement x from a unit-magnification position to a varying-magnification position, the amount of change y in the length of an optical path (hereinafter abbreviated as a "TC length") when switching from unit magnification to varying magnification, the distance "a" between the original and the front-side principal plane of the lens, and the distance b between the imaging plane and the rear-side principal plane of the lens are expressed by the following expressions (1), (2), (3) and (4), respectively. In these expressions, f represents the focal length of the imaging lens (designed value), and m (>0) represents imaging magnification.

The TC length indicates, in the case of FIG. 3, the distance between the surface of the original on an original mount 4 and the surface of a photosensitive member 4 which constitutes the imaging surface of the image of the original.

The main body of the apparatus is configured so that the arrangement of the optical system (the lens unit 35 and the mirror-mount unit 40) is changed in the directions of arrows shown in FIG. 3 (in the directions of the arrows E and R in FIG. 1) according to the following expressions 1 and 2.

$$x=f(1/m-1) \quad (1)$$

$$y=f(m+1/m-2)=(x-f+f^2/(x+f)) \quad (2),$$

where the positive direction of x and y is the moving direction toward R.

$$a=f(1/m+1)=2f+x \quad (3)$$

$$b=f(m+1)=2f-x+y \quad (4).$$

Actually, if the focal length of the lens is assumed to be f'=kf due to errors in production, a =2f'=b' when performing focus adjustment and magnification adjustment at unit magnification at that time. The distance between the original and the front-side principal plane of the lens $a_m'$, and the distance between the imaging surface and the rear-side principal plane of the lens $b_m'$ are expressed by the following expressions (5) and (6), respectively:

$$a_m'=2f'+x \quad (5)$$

$$b_m'=2f'-x+y \quad (6).$$

The actual value of magnification m' of the main body at that time is expressed by the following expression (7):

$$m' = b_m'/a_m' = (2f' + (m-1)f)/(2f' + (1/m-1)f) \quad (7)$$

$$= (2f' + f^2/(x+f) - f)/(2f' + x).$$

Figure 5:
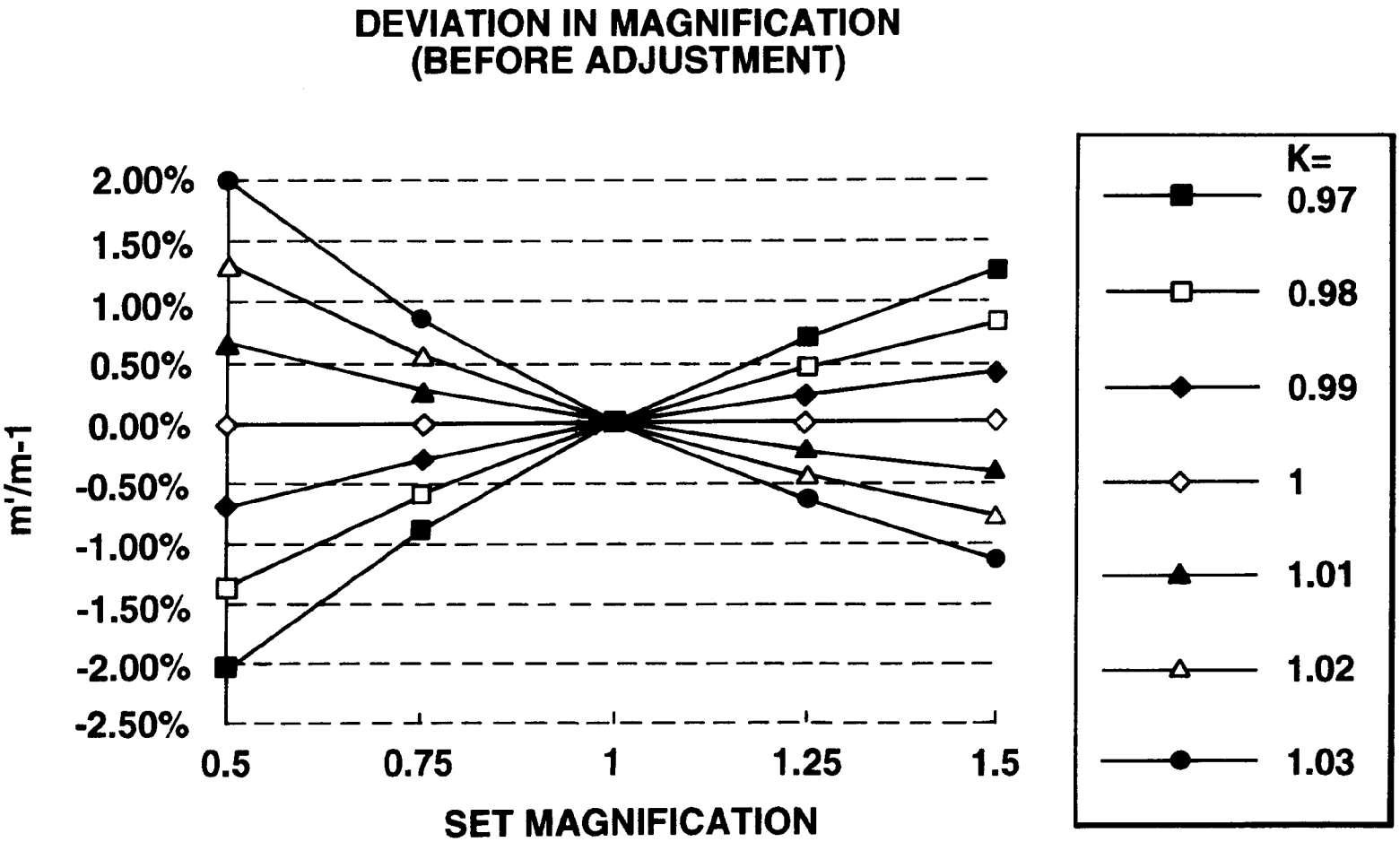
FIG. 5 is a diagram illustrating errors between set values of magnification and actual values of magnification in a state in which the amounts of movement of a lens unit and a mirror are not corrected.

The difference between a desired value of magnification m (a set value of magnification) and an actual value of magnification m' is expressed by the following expression (8) and is shown in FIG. 5:

$$(\text{i } m'/m-1)\times 100\% \quad (8).$$

The amount of lens movement x=x(m) from the position of unit magnification when setting magnification to m can be exactly set for a lens having a designed value f of the focal length. On the other hand, an error in magnification as shown in FIG. 5 is produced for a lens having a focal length f'=kf. FIG. 5 illustrates cases for f=1, $0.5 \leqq m \leqq 1.5$, and $0.97 \leqq k \leqq 1.03$. In the present embodiment, the amount of lens movement is corrected so that x'=x×S (S is a correction value) for a lens having an arbitrary focal length f'. At that time, the above-described expressions (5) and (6) are converted into the following expressions (5') and (6'):

$$a_m'=2f'+x' \quad (5')$$

$$b_m'=2f'-x'+y' \quad (6'),$$

where y' in expression (6') is expressed by the following expression (9):

$$y'=(x'-f+f^2/(x'+f)) \quad (9).$$

From the above-described expression (7), m' is expressed by the following expression (7'):

$$m'=(2f'+f^2/(x'+f)-f)/(2f'+x') \quad (7').$$

As for the correction value S, since the movement of a lens having a focal length f is given as x=f(1/m−1) from the above-described expression (1), it can be understood that the amount of movement expressed by the following expression (10) may be given for a lens having a focal length f'=kf:

$$x'=f'(1/m-1)=kf(1/m-1)=kx. \quad (10).$$

Hence, it is desired that S≈k.

Accordingly, expression (7') is converted into the following expression (11):

$$m'=(2k+1/(k/m-k+1)-1)/(2k+k/m-k) \quad (11).$$

At that time, the difference between the desired value of magnification m (the set value of magnification) and the actual value of magnification m' is expressed by the following expression (12) and is shown in FIG. 3:

$$(m'/m-1)\times 100\% \quad (12).$$

Figure 6:
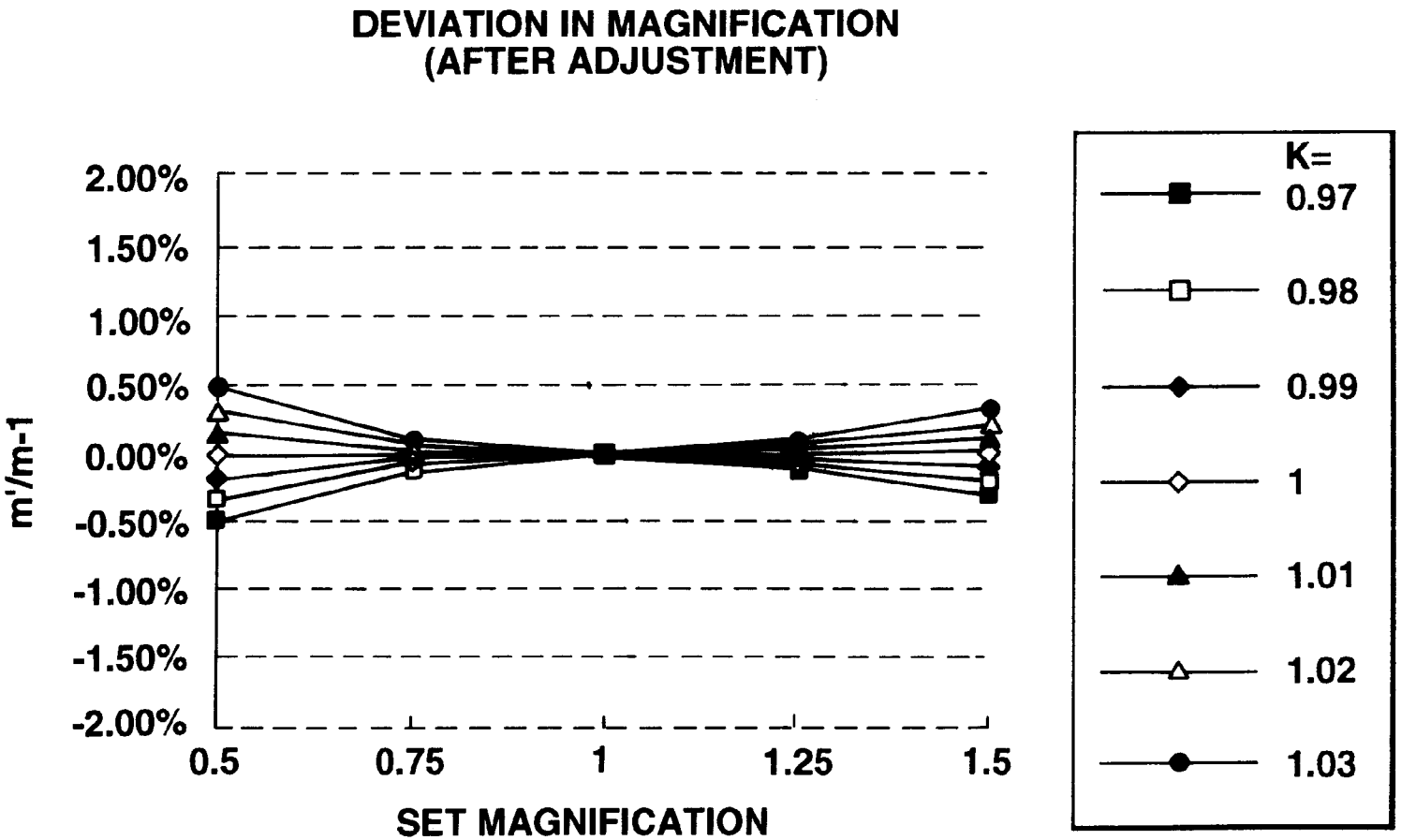
FIG. 6 is a diagram illustrating errors between set values of magnification and actual values of magnification in a state in which the amounts of movement of the lens unit and the mirror are corrected.

As is apparent from comparison between FIGS. 5 and 6, an error in magnification can be reduced to about ¼.

More specifically, the correction value S is expressed by the following expression (13):

$$S=(1+P/100) \quad (13).$$

The values of P shown in the following expression (14) are registered when assembling the main body as correction values for correcting the position of lens movement (the amount of movement), and are used for calculation when using the main body:

$$P=0, \pm 1, \pm 2, \pm 3, \ldots, \pm 30, \ldots, \pm n \quad (14).$$

Figure 7:
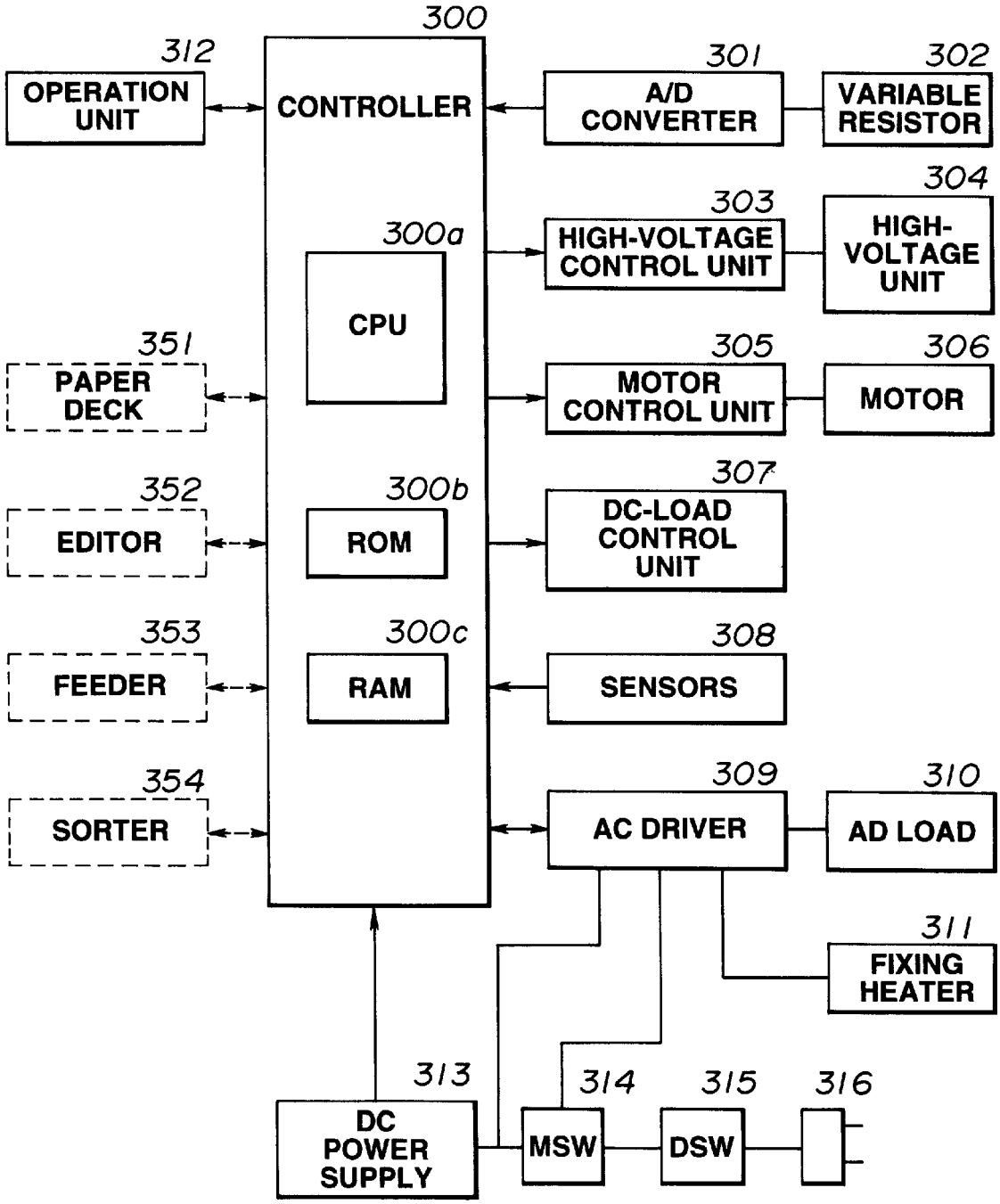
FIG. 7 is a block diagram illustrating an example of control means of the image forming apparatus which uses the image exposure apparatus of the first embodiment.

FIG. 7 is a block diagram illustrating an example of a control system of the image forming apparatus using the image exposure apparatus of the present embodiment.

In FIG. 7, a controller 300 comprises a CPU (central processing unit) 300*a*, a ROM (read-only memory) 300*b*, a RAM (random access memory) 300*c* and the like, and controls the entire copying sequence based on programs stored in the ROM 300*b*.

A key input unit, comprising a copy-number setting key, a copy-magnification setting key, a start key for instructing start of a copying operation, a stop key for instructing stop of a copying operation or for returning the operation mode to a standard state, and the like, and a display unit, comprising LED's (light-emitting diodes) or the like for displaying a state of setting of an operation mode, and the like are disposed on an operation unit 312.

A variable resistor 302 is means for selecting one of the above-described lens correction values P, and detects a lens correction value P corresponding to a variable resistance value (voltage value). A value after A/D conversion by an A/D converter 301 is input to the controller 300.

The motor 30 shown in FIG. 1 is driven by a motor control unit 305 (to be described later) based on the lens correction value P, to correct the stop positions of the lens unit 35 and the mirror-mount unit 40.

A high-voltage control unit 303 controls a charging system, comprising a primary charger, a transfer charger (not shown) and the like, and a high-voltage unit 304 for applying a predetermined voltage to a developing unit (not shown) and the like.

The motor control unit 305 controls driving of a stepping motor, and a motor 306 (including the motor 30 shown in FIG. 1), serving as a main driving motor.

A DC-load control unit 307 controls driving of solenoids, clutches and the like for sheet feeding rollers, registration rollers (not shown) and the like.

Sensors 308 detect, for example, a sheet jam, and the positions of the lens unit 35 and the mirror-mount unit 40. Outputs from the sensors 308 are input to the controller 300.

An AC driver 309 controls AC electric power supply to an AC load 310, comprising an original-illuminating lamp (not shown) and the like, and a fixing heater 311. The AC driver 309 also detects abnormality in the fixing heater 311 and the like, and turns off a main switch (MSW) 314 having a shut-off function whenever necessary.

A DC power supply 313 supplies the controller 300 and the like with DC electric power. AC electric power supplied from a power-supply plug 316 is input to the DC power supply 313 via a door switch (DSW) 315 and a main switch 314.

In FIG. 7, there are also shown a paper deck 351, an editor 352, a feeder 353, and a sorter 354.

Figure 8:
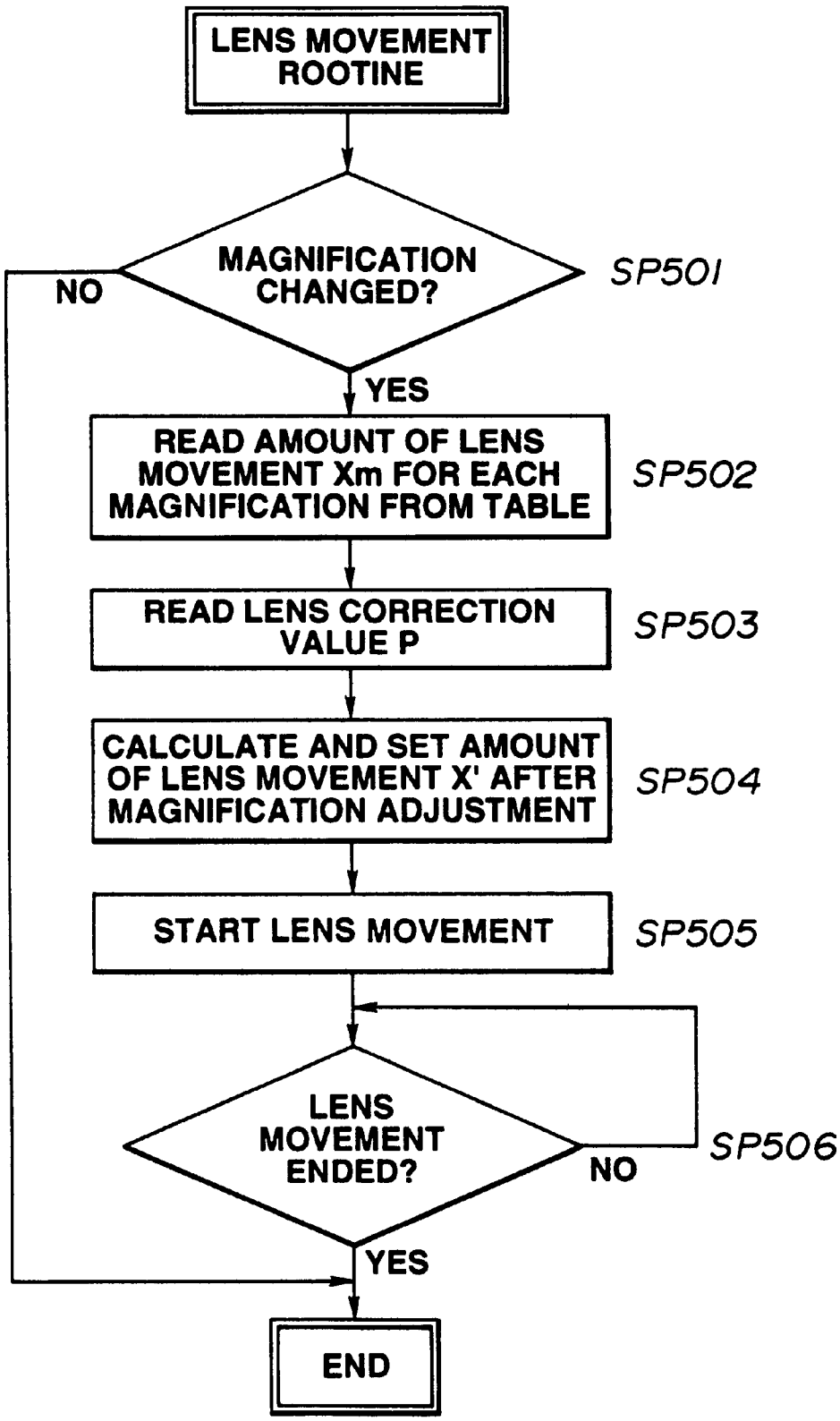
FIG. 8 is a diagram illustrating a lens movement routine in the image exposure apparatus of the first embodiment.

Next, a description will be provided of control means of a specific magnification-varying mechanism with reference to the flowchart shown in FIG. 8 and the schematic diagram shown in FIG. 7.

First, a description will be provided of a movement routine of the lens unit 35, i.e., a lens movement routine with reference to the flowchart shown in FIG. 8. The amount of lens movement is provided by making the principal plane of the lens to be a reference.

If setting of magnification has not been changed in step SP501 through the copy-magnification setting key or the like provided on the operation unit 312, it is unnecessary to move the lens. Therefore, the routine is terminated. If setting of magnification has been changed in step SP501, the lens must be moved. Therefore, the process proceeds to step SP502.

In step SP502, the amount of lens movement Xm set for each magnification m is read from a data table as shown in FIG. 9 which is stored in the ROM 300*b*. For example, when magnification is set to 70%, an image having a value of magnification of 70% can be formed by moving the lens from the position of 100% by an amount of movement $X_{70}$ (mm). However, this is a set value of magnification, and is not an actual value of magnification. The amount of movement Xm from the position of 100% is stored for each value of magnification.

In step SP503, the above-described lens correction value P selected in advance by adjustment of the variable resistor 302 is read. The lens correction value P is selected, for example, by performing measurement so as to provide an appropriate value of magnification by a magnification measuring apparatus (not shown) when assembling the main body of the apparatus, and performing adjustment by changing the resistance value (voltage value) of the variable resistor 302. When the appropriate value of magnification has been obtained, the operation of changing the resistance value of the variable resistor 302 is stopped, and magnification adjustment is completed by fixing the value of the variable resistor 302 to the value (voltage value) obtained at that time. Alternatively, for example, one of the resistance values predetermined in accordance with the lot numbers of lenses or the lot numbers of cams may be selected.

Figure 10:
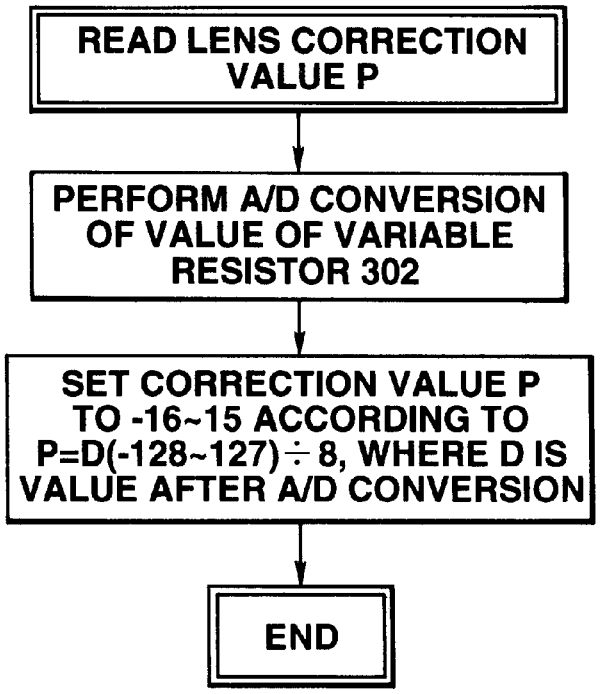
FIGS. 10 and 11 are flowcharts after selection of a correction value using a variable resistor until calculation of an amount of lens movement.

Next, a method of reading the lens correction value P will be described in detail with reference to FIG. 10. The value of the variable resistor 302 is subjected to A/D conversion by the A/D converter 301. If the value after the A/D conversion is represented by D, and if the value D comprises 8 bits, the value D is received by the controller 300 as 0–FFH (−128–127). For example, if the range of adjustment of the lens correction value P is −16–+15, the lens correction value P is read according to calculation of P=D÷8.

The motor 30 shown in FIG. 1 is driven by the motor control unit 305 based on the lens correction value P, to correct the stop positions of the lens unit 35 and the mirror-mount unit 40.

Figure 11:
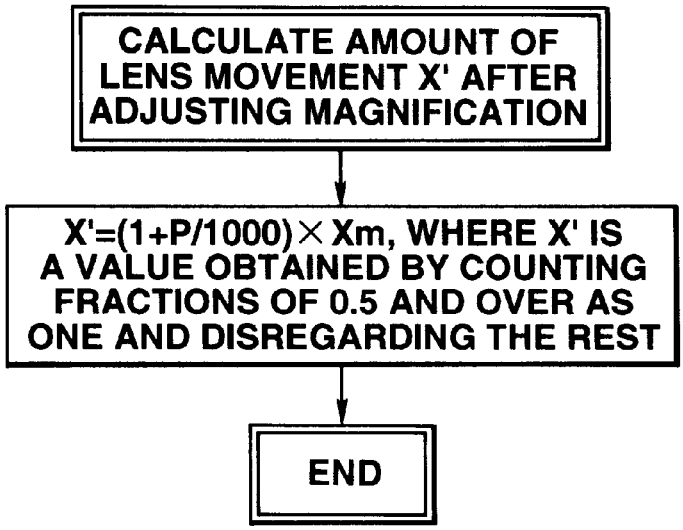

In step SP504, the amount of lens movement X' after magnification adjustment is calculated and set using the amount of lens movement Xm and the lens correction value P. The amount X' is calculated, as shown in FIG. 11, according to $X'=(1+P/1000)\times Xm$ using the above-described expression (13).

In step SP505, movement of the lens is started. When the movement of the above-described amount X' has been completed in step SP506, the routine is terminated.

As described above, the arrangement of the lens unit 35 and the mirror-mount unit 40 is changed in a state in which magnification is adjusted, and thereafter, image exposure on the photosensitive member is performed with the changed value of magnification.

That is, since magnification adjustment of the optical system can be performed based on the lens correction value P by only selecting the resistance value (voltage value) of the variable resistor 302, the operability in magnification adjustment can be improved.

Furthermore, since the means for selecting the lens correction value P comprises the variable resistor 302, a DC controller circuit can be simplified in control means.

Upon completion of the above-described movement routine, image formation with the set value of magnification is performed using the start key (not shown) on the operation unit 312.

By performing image formation by a magnification-varying apparatus in a state in which magnification adjustment is performed in the above-described manner, an error between a set value of magnification and an actual value of magnification is reduced. Hence, the resolving power and accuracy in magnification can be improved.

Second Embodiment

Recently, in many apparatuses having multiple functions, the RAM 300*c* is configured by a nonvolatile memory so as to hold (back up) necessary data. A description will now be provided of adjustment means in which the configuration of the first embodiment is applied to an apparatus having means for backing up data by another function (a copy-number counter or the like in the case of an image forming apparatus), according to a second embodiment of the present invention.

Figure 12:
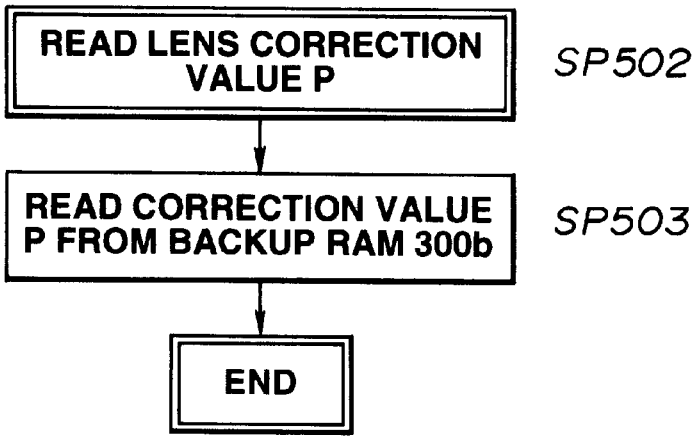
FIGS. 12 and 13 are flowcharts when reading a correction value by rewriting the contents of a RAM (random-access memory) instead of using a variable resistor according to a second embodiment of the present invention.

A lens movement routine will be described with reference to the flowchart shown in FIG. 12.

Since the processing of steps SP501–SP502 is the same as in the first embodiment, a further description thereof will be omitted.

Figure 13:
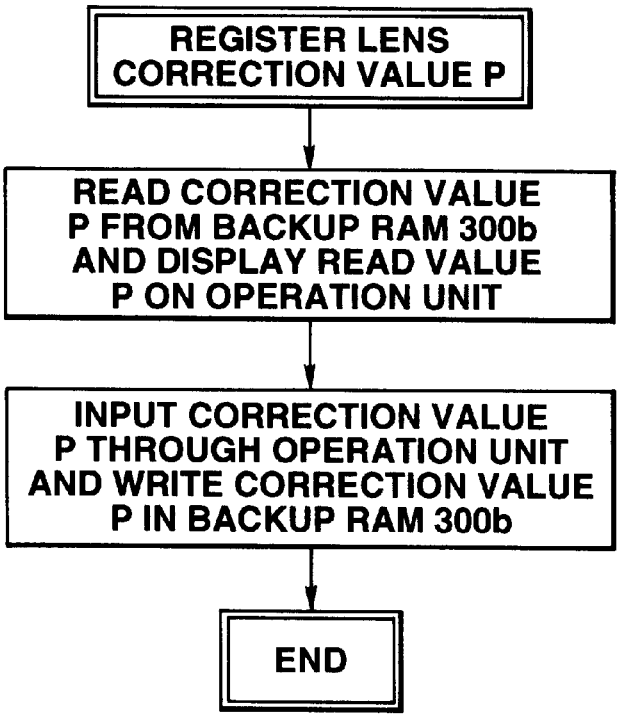

In step SP503, the above-described lens correction value P adjusted and registered in advance is read. Instead of performing measurement by a magnification measuring apparatus (not shown) so as to provide an appropriate value of magnification when assembling the main body of the apparatus, and performing adjustment by changing the resistance value (voltage value) of the variable resistor 302, the lens correction value P is selected by adjusting magnification by rewriting data stored in the nonvolatile RAM 300*c* through the operation unit 312. The detail of such an operation will be described with reference to FIG. 13.

The lens correction value P, serving as an initial value, which has been written in advance, is read from the nonvolatile RAM 300*c*, and the correction value P is displayed on a display unit of display means (not shown) on the operation unit 312, serving as information input means. The lens correction value P is input through a key, such as the copy-number setting key or the like on the operation unit 312, and is held, i.e., written, in the nonvolatile RAM 300*c* and is displayed. Magnification adjustment is completed by stopping to rewrite the lens correction value P in the nonvolatile RAM 300*c* when an appropriate value of magnification has been obtained, and the lens correction value P at that time is held.

The detail of the method of reading the lens correction value P will now be described with reference to FIG. 12. The lens correction value P is read from the nonvolatile RAM 300*c*.

The motor 30 shown in FIG. 1 is driven by the motor control unit 305 based on the lens correction value P, to correct the stop positions of the lens unit 35 and the mirror-mount unit 40.

In step SP504, the amount of lens movement X' after magnification adjustment is calculated and set using the amount of lens movement Xm and the lens correction value P. The amount X' is calculated, as shown in FIG. 11, according to $X'=(1+P/1000)\times Xm$ using the above-described expression (13).

In step SP505, movement of the lens is started. When the movement of the above-described amount X' has been completed in step SP506, the routine is terminated.

Thereafter, image formation with the set value of magnification is performed using the start key (not shown) on the operation unit 312.

As described above, in the configuration of an apparatus having means for backing up data by another function (a copy-number counter or the like in the case of an image forming apparatus), by using the nonvolatile RAM 300*c* as backup means (holding means), the above-described effects can be easily obtained without increasing the cost of the apparatus.

In each of the above-described embodiments, a correction value is selected (registered), for example, in accordance with the lot number of a component used in the apparatus, and an actual amount of movement of the lens unit is calculated by reading the correction value during a magnification-varying operation. However, an actual amount of movement itself of the lens unit may be selected (registered), for example, in accordance with the lot number of a component used in the apparatus, in order to simplify calculation of the amount of movement during a magnification-varying operation.

The individual components shown in outline or designated by blocks in the drawings are all well known in the image exposure apparatus arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image exposure apparatus comprising:

an optical system capable of focusing an image of an original onto a surface to be exposed by changing magnification, said optical system comprising a single-focus lens unit movable in a direction of an optical axis, and a mirror which moves when switching the length of an optical path;

driving means for driving said single-focus lens unit and said mirror;

a variable resistor for correcting a driving amount of said driving means;

control means for controlling the amount of driving of said driving means in accordance with a set magnification and a set resistance value of said variable resistor.

2. An image exposure method comprising the steps of:

determining whether a magnification setting has been changed;

identifying an ideal amount of movement of a lens unit for a set value of magnification;

prestoring a lens unit correction value in accordance with a focal length of the lens unit;

reading a lens unit correction value;

calculating an actual amount of movement of the lens unit using the ideal amount of movement of the lens unit identified in said identifying step and the lens unit correction value read in said reading step; and driving a lens unit based on the actual amount of movement of the lens unit calculated in said calculating step, wherein the lens correction value read during said reading step is selected by measuring an appropriate value of magnification using a magnification measuring apparatus during assembly of a main body of an imaging apparatus, and adjusting the resistance value of a variable resistor.

3. The image exposure method of claim 2, wherein the lens correction value read during said reading step is selected by measuring an appropriate value of magnification using a magnification measuring apparatus during assembly of a main body of an imaging apparatus, and rewriting the lens correction value stored in a memory device.

4. The image exposure method of claim 2, further comprising:

forming an image on a photosensitive member at the magnification setting determined in said determining step.

* * * * *

UNITED STATES PATENT AND TRADEMARK OFFICE

CERTIFICATE OF CORRECTION

PATENT NO. : 5,940,663

DATED : August 17, 1999

INVENTOR(S) NOBORU MIZUMUMA, ET AL.

It is certified that error appears in the above-identified patent and that said Letters Patent is hereby corrected as shown below:

SHEET 7,
Fig. 8, "ROOTING" should read --ROUTINE--.

COLUMN 2,
Line 49, "is" (second occurrence) should be deleted.
Line 61, "invention," should read --invention--.

COLUMN 3,
Line 25, "magnification-vaying" should read --magnification-varying--.

COLUMN 5,
Line 57, "(i m'/m-1)x100%" should read --(m'/m-1)x100%--.
Line 61, "designed" should read --designated--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*